US006547521B2

(12) United States Patent
Bartholomäet al.

(10) Patent No.: US 6,547,521 B2
(45) Date of Patent: Apr. 15, 2003

(54) FLOW DUCT GUIDE APPARATUS FOR AN AXIAL FLOW TURBINE

(75) Inventors: Klaus Bartholomä, Landsberg/Lech (DE); Karl Heinz Schrott, Augsburg (DE)

(73) Assignee: MAN B&W Diesel Aktiengesellschaft, Augsburg (DE)

( * ) Notice: Subject to any disclaimer, the term of this patent is extended or adjusted under 35 U.S.C. 154(b) by 0 days.

(21) Appl. No.: 09/825,955

(22) Filed: Apr. 4, 2001

(65) Prior Publication Data

US 2001/0026758 A1 Oct. 4, 2001

(30) Foreign Application Priority Data

Apr. 4, 2000 (DE) ..... 100 16 745

(51) Int. Cl.[7] ..... F01D 17/16
(52) U.S. Cl. ..... 415/160
(58) Field of Search ..... 415/113, 129, 415/134, 136, 151, 160, 161, 162, 163, 164, 173.1, 173.3

(56) References Cited

U.S. PATENT DOCUMENTS

| | | | | |
|---|---|---|---|---|
| 3,652,177 A | * | 3/1972 | Loebel | 415/110 |
| 3,999,883 A | | 12/1976 | Nordenson | 415/113 |
| 4,385,864 A | | 5/1983 | Zacherl | 415/136 |
| 4,861,228 A | * | 8/1989 | Todman | 415/115 |
| 5,269,651 A | * | 12/1993 | Ostermeir et al. | 415/134 |
| 5,672,047 A | * | 9/1997 | Birkholz | 415/160 |
| 5,873,700 A | * | 2/1999 | Ichikawa | 415/200 |
| 6,129,512 A | * | 10/2000 | Agram et al. | 415/160 |

FOREIGN PATENT DOCUMENTS

| | | |
|---|---|---|
| DE | 27 40 192 | 3/1979 |
| DE | 29 31 766 | 2/1981 |
| DE | 42 18 229 | 3/1993 |
| DE | 42 13 709 | 10/1993 |
| DE | 42 37 031 | 2/1994 |
| GB | 1 223 390 | 2/1971 |

* cited by examiner

*Primary Examiner*—Edward K. Look
*Assistant Examiner*—Richard A. Edgar
(74) *Attorney, Agent, or Firm*—Cohen, Pontani, Lieberman & Pavane

(57) ABSTRACT

In order to make the components of a guide apparatus for an axial flow turbine easy to activate and also to permit only small gap flows, an axial flow machine is proposed with a guide apparatus, which comprises a row of adjustable guide vanes in the flow duct, which flow duct is bounded, on the one hand, by an inner spherically configured hub and, on the other hand, by an outer spherically configured guide vane carrier, the guide vanes being, on the one hand, rotationally supported in radial bearing holes of the annular guide vane carrier and, on the other hand, the spherically configured tip and root profiles of the guide vanes sealing against the guide vane carrier and the hub, in which arrangement the hub is embodied with a flexible hub contour at least in the sealing region of the inner tips of the guide vanes and the support for the guide vanes in the direction of the guide vane axes (A) is likewise designed to be flexible.

6 Claims, 1 Drawing Sheet

FLOW DUCT GUIDE APPARATUS FOR AN AXIAL FLOW TURBINE

BACKGROUND OF THE INVENTION

1. Field of the Invention

The invention relates to an axial flow machine, in particular a turbine with a guide apparatus in the flow duct, which guide apparatus comprises a row of adjustable guide varies and is bounded, on the one hand, by an inner hub and, on the other hand, by an outer guide vane carrier, the guide vanes being, on the one hand, rotationally supported in radial bearing holes of the annular guide vane carrier and, on the other hand, the tip profile of the guide vanes sealing against the guide vane carrier and the root profile of the guide vanes sealing against the hub, i.e. the guide vanes are supported at one end.

2. Description of the Related Art

Adjustable, in particular turbine, guide apparatus is, as is known, employed in turbine and turbocharger construction in order to permit better matching of the turbine to the particular operating conditions occurring during operation. This is because, in the case of an exhaust gas turbocharger, for example, the characteristics specified, in association with a piston machine of high specific power, make it difficult to make the desired air quantity available over the whole of the operating range. By adjustment of the guide apparatus cross section, the boost pressure, and therefore the air quantity available, for a given load point can therefore be modified within certain limits. By opening the turbine cross section with increasing load, in accordance with a specified characteristic, the increase in pressure can then be limited in such a way that, at full load, the scavenging air pressure, and therefore also the ignition pressure and the fuel consumption, are set to those for the normally designed engine.

The efficiency of the turbine with an adjustable turbine guide apparatus can therefore also be raised or lowered, particularly in the case of operation away from the design point.

Adjustable turbine guide apparatus usually have a plurality of guide vanes which are rotatably arranged about an axis and which can be connected in an articulated manner by means of levers and setting rings.

A fundamental distinction must be drawn between adjustable turbine guide apparatus for axial and radial flow turbines. Whereas the radial flow adjustable turbine guide apparatus can be of relatively simple construction (see, for example DE 42 18 229 C1), it is essentially more complicated to realize the axial flow arrangement because the hub and inlet casing contours, in particular, must be designed to be spherical, i.e. at least curved. This is necessary in order to generate a uniform radial gap relative to the hub and inlet casing contours at all guide vane settings.

DE 42 13 709 A1 reveals an axial flow machine of the generic type, in particular an axial flow turbine. In this case, the adjustable turbine guide apparatus offers the possibility of reducing the flow cross section in the turbine at part load of the engine by rotating the guide vanes and, by this means, of raising the air pressure before the cylinder.

The previously known axial flow, adjustable turbine guide apparatus comprises, within the walls bounding the annular flow duct, the inner hub, on the one hand, and, on the other hand, the outer guide vane carrier which encircles the hub as an annulus. This guide vane carrier is secured in the inlet casing of the turbine. The actual adjustment of the guide vane takes place by means of a linkage lever and, preferably, automatically as a function of the operating parameters such as supercharge pressure, rotational speed, etc.

In order to keep the flow losses in an axial flow, adjustable turbine guide apparatus, the gaps between the guide vanes and the inlet casing, and/or the hub, must be kept as small as possible. Various measures have already become known for this purpose, such as the guide vanes having a rotary trunnion, which is supported in the guide vane carrier and a vane rotary plate which is sealed relative to the inlet casing (see, for example, DE 27 40 192 C2 or DE 42 37 031 C1).

On the other hand, and so that the guide vanes do not jam during "hot" operation, they must usually be installed with appropriate clearance. So that easy adjustment can also be ensured in the case of load changes, i.e. in the case of differential thermal expansion between the components of the guide apparatus, sufficiently large gaps have previously been accepted but these, i.c. the resulting gap flows at the tip and at the root of the guide vanes, can greatly perturbate the main flow in the duct.

These two requirements for, on the one hand, minimizing the gap cross sections and, on the other hand, easy adjustability of the components, are mutually contradictory and, for this reason, the adjustable, axial flow turbine guide apparatus realized in the past were either running easily or had small flow losses.

SUMMARY OF THE INVENTION

The invention is based on the object of developing an axial flow machine of the type mentioned at the beginning in such a way that the components of the guide apparatus are both easily actuated and permit only small gap flows. It is, therefore, required to combine both the requirements quoted above in a new axial flow machine.

The object is achieved by the provision in an axial flow machine such as a turbine, of guide apparatus in the flow duct. This apparatus comprises a row of adjustable guide vanes, these being bounded at one end by an inner hub and at an opposite end by an outer guide vane carrier. The guide vanes are rotatably received in and flexably supported in radial bearing holes in the vane carrier. The vanes each have a tip profile and a root profile, the guide vane tip profiles sealing against an inner contour of the vane carrier, and the root profiles sealing against a flexible contour part of the inner hub.

Because, at least in the sealing region at the root profile of the guide vanes, the hub is embodied with a flexible hub contour and the single-end support of the guide vanes in the guide vane carrier in the direction of the guide vane axes likewise has a flexible configuration, the flow losses through gaps between the guide vane contours and the inlet casing and hub contours can be reduced and, in addition, stressing of the components of the adjustable guide apparatus, caused by sealing elements and by thermal expansion of the components, is avoided.

The fact that the flexible configuration of the support for the guide vanes in the guide vane carrier by means of a spring acting, in each case, in the direction of the guide vane axes, in particular a plate spring is achieved in a particularly advantageous manner ensures that the tip profile of a guide vane is in contact with the inlet casing contour in each operating condition, by which means the gap between these two components can be kept very small or can be avoided altogether.

Because the flexible hub contour is embodied, in an advantageous manner, in the form of an inner ring, which is fitted into the hub contour and which is supported, in the preloaded condition, against the root profiles of the guide vanes, this inner ring is always in contact with the guide vane contours.

In a preferred embodiment, furthermore, the inner ring is provided with a slot for assembly so that, here again, it is possible to compensate for thermal expansion. The slot is arranged in such away that it is located between two guide vanes such that a guide vane movement during an adjustment procedure bypasses said slot, so that the losses caused by the slot can be minimized.

Because, in addition, the slot is covered, relative to the hub internal space, by means of a sealing plate, which isolates a communication between a hub internal space and the flow duct, mass flow losses through the slot can be avoided.

In a preferred embodiment, the inner ring is flanged onto the hub in such a way that it can be moved in the radial direction of the inlet flow casing, i.e. in the direction of the guide vane axis, but is inserted into the hub contour with only small clearance in the axial direction of the inlet flow casing so there is no substantial movement of the ring in said inlet flow casing axial direction. Mass flow losses are again avoided by this measure.

In the preferred embodiment example, the inner contour of the annular guide vane carrier, the hub and the tip profile and root profile of the guide vanes have a corresponding spherical configuration in order to improve the sealing effect.

Although, due to the configuration of the guide apparatus of a generic axial flow machine according to the invention, increased friction between the components is accepted, jamming of the mechanism caused by different thermal expansion of the components is effectively prevented. The selection of materials can be such that guide vanes manufactured by the casting process in a highly heat-resistant material are supported in a ceramic guide vane carrier and seal, by means of their root profiles, against a likewise cast hub. At the same time, this ensures that the gaps between the guide vane and inlet casing, or hub, can be kept as small as possible so that the flow losses can be reduced to a minimum.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
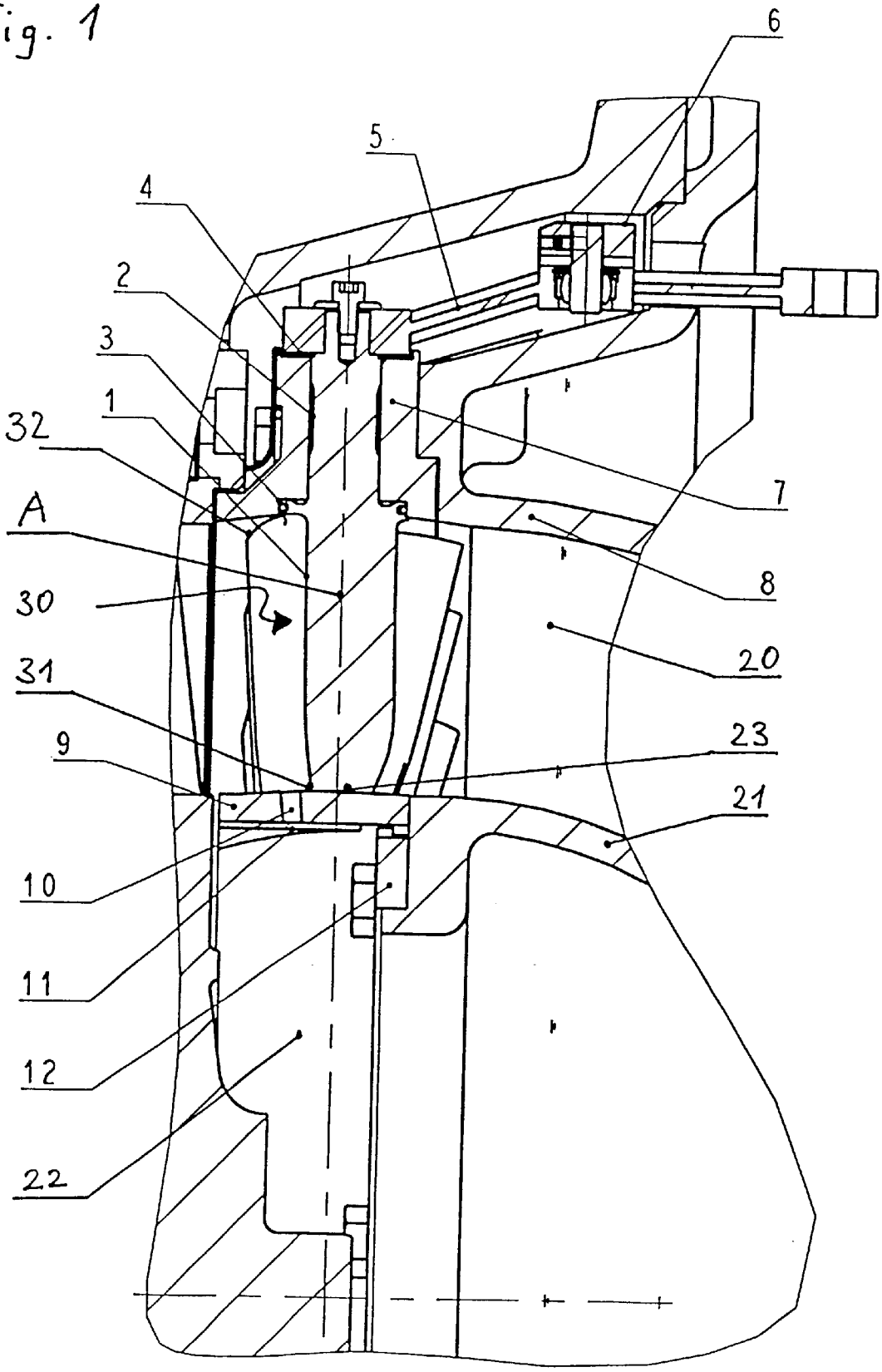
FIG. 1 shows a partial longitudinal section through an exhaust gas turbocharger turbine, only elements of the adjustment apparatus being shown.

An axial flow, annular duct 20 of an axial turbine is bounded, on the one hand, by an inner hub 21 and, on the other hand, by an annular guide vane carrier 7 together with an inlet housing 8. The guide vane carrier 7 is secured in the inlet housing 8 (In a manner not described in any more detail).

The adjustable guide vanes 30 each comprise a guide vane aerofoil 1, a vane trunnion 2 and a vane rotary plate 3. An end of the vane, i.e., a trunnion end is rotatably supported in a radial bearing hole of the annular guide vane carrier 7 and is fastened on the guide vane carrier 7 in a known manner, for example by means of a screwed-on castellated nut or the like. FIG. 1 shows a cross section of the vane trunnion 2 through the radial bearing hole in the guide vane carrier. On the outside of the guide vane carrier 7, a linkage lever 5 is placed on the extended trunnion 2 of the guide vane 30 and is rotationally secured by means of a feather key. The linkage lever 5 is in contact with the vane trunnion 2 and the guide vane carrier 7, with the intermediary connection of a plate spring 4, so that the linkage lever 5 is supported by the guide vane carrier 7. The plate spring 4 exerts a preloading force on the vane trunnion 2 and this preloading force presses the root profile 31, i.e. the lower contour of the guide vane aerofoil 1, against the outer surface of the hub 21, i.e. the root profile 31 of the guide vane 3C is in contact with the hub 21 and is therefore sealed against the contour of the hub 21. Guide vane tip profile 32 seals against an inner contour of the guide vane carrier 7. Because of this, the vane trunnion 2 has practically no clearance in the bearing hole of the guide vane carrier 7 but is, nevertheless, elastically clamped, with vibration damping, against thermal expansion in the direction of the axis A of the guide vane 30. The vane rotary plate 3 seals the duct 20 against the bearing hole of the guide vane carrier 7.

The linkage lever 5 can be moved, in known manner, by a setting ring 6 and actuation means (not shown in any more detail).

The casing contour of the hub 21 is designed to be at least partially spherical, with the inclusion of a hollow or internal space 22.

In the sealing region 23 of the root profile 31 of the guide vane 30, an inner ring 9 is fitted into the hub contour, which inner ring 9 is supported in the preloaded condition against the root profile 31 of the guide vane 30 and is fastened on the hub 21 by means of a flange 12 in such a way that, although it can be moved in the direction of the axis A of the guide vane 30, it has only a small amount of clearance in the contour of the hub 21, i.e. in the axial direction of the duct 20. To this end, there is, for example, only tooth contact between flange 12 and inner ring 9.

The inner ring 9 is itself provided with a slot 10, which is arranged in such a way that it is located between two guide vanes and the vane contour does not pass over it during the adjustment procedure. In order to prevent mass flow losses through the slot 10, it is covered, viewed from the hollow or internal space 22 of the hub 21, by a sealing plate 11.

The invention would also be analogously applicable in the case of compressors. In addition, use in the case of axial fans is to be included.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A flow duct guide apparatus for an axial flow turbine, comprising:

an inner hub, said inner hub having a region of flexible contour;

an annular outer guide vane carrier having a plurality of radial bearing holes;

a row of adjustable guide vanes disposed in the flow duct, each guide vane having a tip profile and a root profile, the tip profiles of said guide vanes being rotatably received in said radial bearing holes, the tip profile of said guide vanes sealing against said guide vane carrier, the root profile of said guide vanes sealing against said hub region of flexible contour; and a spring flexibly supporting the tip profile of each of said guide vanes in a direction of the respective axes of said each of said guide vanes for facilitating closure of gaps created by thermal expansion between the root profile of said each of said guide vanes and said hub region of flexible contour.

2. A flow duct guide apparatus according to claim 1, wherein said vane carrier has an inner contour, said vane carrier inner contour, said inner hub, and said tip profiles and said root profiles have correspondingly spherically configured surfaces for improving sealing between inner contour and said tip profiles, and between said inner hub and said root profiles.

3. A flow duct guide apparatus according to claim 1, wherein the inner hub region of flexible contour comprises a ring, said ring having a pre-loaded condition acting against the guide vane root profile.

4. A flow duct guide apparatus according to claim 3, wherein said ring is attached in the inner hub so as to be movable codirectionally of the guide vane axes but without any substantial movement in a flow duct axial direction.

5. A flow duct guide apparatus according to claim 3, wherein said ring includes a slot, said slot being disposed between adjacent guide vanes at a location such that a guide vane movement bypasses said slot.

6. A flow duct guide apparatus according to claim 5, comprising a sealing plate covering said slot and isolating a communication between a hub internal space and the flow duct.

* * * * *